US006671884B1

(12) United States Patent
Griesbach, III et al.

(10) Patent No.: US 6,671,884 B1
(45) Date of Patent: Jan. 6, 2004

(54) METHOD FOR DEFINING AREAS OF A PROTECTIVE GARMENT SUBJECTED TO STRETCHING FORCES WHEN WORN BY WEARER

(75) Inventors: Henry L. Griesbach, III, Clarkston, GA (US); Linda Harris, Lawrenceville, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/286,378

(22) Filed: Nov. 1, 2002

(51) Int. Cl.[7] ..... A41B 9/00
(52) U.S. Cl. ..... 2/69; 2/92
(58) Field of Search ..... 2/88, 52, 92, 69, 2/114, 901, 87, 83, 82, 51, 102, 106, 115, 116, 46; 33/2 R, 5, 6, 3 A, 3 B, 3 C, 17 R; 602/58, 59; 604/304, 378, 381, 382; 450/92, 93, 156

(56) References Cited

U.S. PATENT DOCUMENTS 3,654,632 A 4/1972 Lacroix
4,525,407 A 6/1985 Ness
4,698,849 A 10/1987 Mitchell et al.
5,097,534 A 3/1992 Viemeister et al.
5,461,724 A 10/1995 Wiedner et al.
5,492,753 A 2/1996 Levy et al.
5,582,903 A 12/1996 Levy et al.
5,695,849 A 12/1997 Shawver et al.
5,724,674 A 3/1998 Covington et al.
5,794,276 A 8/1998 Walker
5,883,028 A 3/1999 Morman et al.
6,028,240 A 2/2000 Wessel et al.
6,052,826 A 4/2000 Tolton
6,115,839 A 9/2000 Covington et al.

OTHER PUBLICATIONS

U.S. patent application Publication, U.S. 2002/0138893, Oct. 3, 2002, Culhane, Steven D.*

* cited by examiner

*Primary Examiner*—Gary L. Welch
(74) *Attorney, Agent, or Firm*—Dority & Manning

(57) ABSTRACT

A method is provided for defining areas of a protective garment, such as a surgical gown, that are subjected to tensile stretching forces when worn by a wearer. Once identified, such areas may be substituted with elastomeric patches so that restrictive forces experienced by wearers of the garment are relieved.

14 Claims, 7 Drawing Sheets

METHOD FOR DEFINING AREAS OF A PROTECTIVE GARMENT SUBJECTED TO STRETCHING FORCES WHEN WORN BY WEARER

TECHNICAL FIELD OF THE INVENTION

The present invention relates generally to the field of protective garments, and more particularly to an improved surgical gown configuration.

BACKGROUND

Protective garments such as surgical gowns are well known. The usefulness of these garments is generally influenced by a number of factors, such as breathability, resistance to fluid flow, barrier protection qualities, etc. Comfort of the garment is also an important factor. For example, a surgical gown must be comfortable to a person wearing the garment for extended hours.

Factors affecting the comfort of the garment include the stretch properties, softness, and breathability of the garment material. Materials that are soft, stretchable, and breathable are typically more comfortable than materials that do not have those characteristics.

Conventional disposable surgical gowns are commonly constructed from a nonwoven fabric. The gown body section is generally a singular piece of material, or is composed of a number of panels of material attached together, for example, a front panel and attached side panels that also define a back section of the gown. Sleeves are attached to the gown body by any number of known techniques. An example of a surgical gown made using raglan-type sleeves attached to a one piece gown body is the Lightweight Gown (product code 90751) from Kimberly-Clark, Corp. of Neenah, Wis., USA. When a gown of this type is donned and the wearer's arms are extended outward in front of the torso and crossed, the fabric in the back shoulder area is tensioned and felt as a restrictive force against the wearer's shoulders. This restrictive force is most often identified by wearers in the area where the gown body fabric joins the back and underside of the sleeves.

A common method to attempt to reduce (relieve) restrictive forces is to incorporate more fabric in the areas placed under tension, such as via pleats, or inserted secondary patches. Another approach suggested in the art is to construct the gown body out of an elastomeric or recoverable-stretch material so that when the fabric is subjected to the restrictive forces (the forces encountered by a non-elastomeric fabric), the fabric elongates. Various elastomeric nonwoven materials and fabrics are available for such purpose, including laminates of a nonwoven web and elastomeric film.

A drawback of making the entire gown body, or entire panel portions, of an elastomeric material is that such materials are significantly more costly, and thus add to the overall cost of the product and healthcare in general.

The present invention relates to a unique method for precisely determining the areas of a protective garment that are subjected to tensile stretching forces so that such areas may be substituted with an elastomeric material.

SUMMARY

Objects and advantages of the invention will be set forth in the following description, or may be obvious from the description, or may be learned through practice of the invention.

The present invention relates to a method useful in making a unique configuration of a protective garment, particularly a surgical gown, wherein patches of extensible material are selectively provided in the gown in the areas of maximum stress (i.e., the areas subjected to a maximum stretching force when worn by a wearer). The extensible patch areas are completely surrounded by the remaining material of the gown (generally a non-extensible material) and, thus, may be thought of "islands" of extensible material strategically located in the gown. In one particular embodiment, the predefined areas of stress that are placed under a tensile stretching force when the garment is worn are located in the back shoulder portions of the gown body. It is in this area that the extensible material patches are disposed. In the embodiment wherein the back portion of the gown is open and defined by back panel sections, an extensible material panel is provided in each of the back shoulder portions of each panel.

The method according to the invention allows for relatively precise definition of the areas of a garment that are subjected to tensile stretching force when worn by a wearer under normal conditions. Once identified, these areas may be substituted with elastomeric material. In a process as described herein, the stressed areas may be empirically determined and mapped out on the gown body for subsequent replacement with extensible material patches.

The extensible material patches are not limited to any particular shape. In one particular embodiment, the patches are crescent shaped and generally follow the contour of the sleeve openings in the gown body. In another embodiment, the extensible material patches are generally elongated members having a longitudinal dimension greater than a lateral dimension. The precise shape of the patches can be empirically determined as described herein.

It should be appreciated that a garment, in particular a surgical gown, constructed in accordance with the invention is not limited to any particular type of materials. Conventional materials for forming the body and sleeves of a gown are well known to those skilled in the art, and any such material may be used for a gown in accordance with the present invention. Likewise, there are a number of elastomeric extensible materials used in the art that may serve adequately as the extensible material patches for use in the present invention. Examples of such materials will be described in greater detail below.

The garment according to the invention may have a conventional body configuration. For example, the garment may have a closed front portion that is made from a first panel of material and an open back portion defined by back panels that are attached to the first panel of material alongside the seams of the garment. In an alternate embodiment, the garment may have front and back portions formed from a single piece of material. The style and configuration of the garments is not a limiting factor. Regardless of the type of garment, once the areas of maximum stress or tensile force are mapped and identified, extensible material patches may be incorporated into the gown at these areas.

The invention will be described in greater detail below by reference to embodiments illustrated in the figures.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

DETAILED DESCRIPTION

Figure 1:
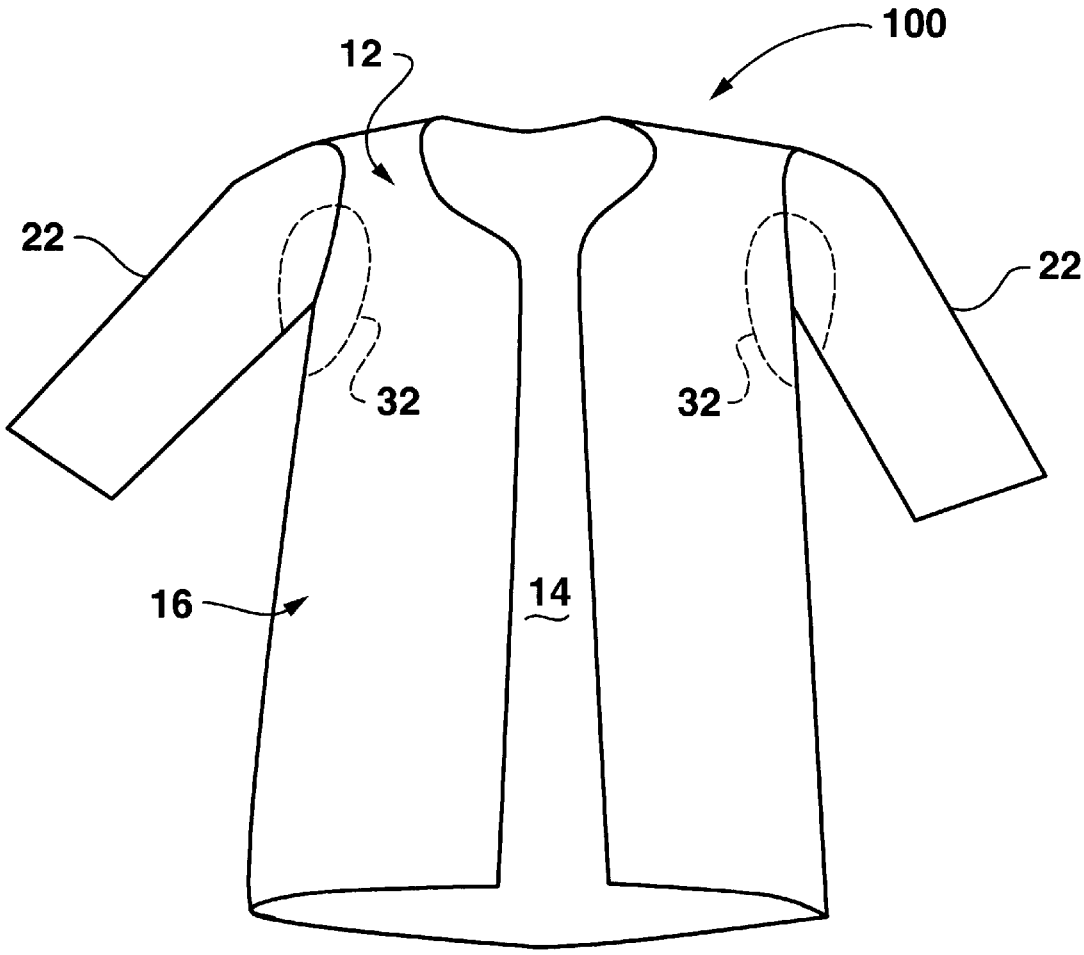
FIG. 1 Prior Art
FIG. 1 is a perspective view of a prior art surgical gown.

Reference will now be made in detail to one or more embodiments of the invention, examples of which are graphically illustrated in the drawings. Each example and embodiment are provided by way of explanation of the invention, and not meant as a limitation of the invention. For example, features illustrated or described as part of one embodiment may be utilized with another embodiment to yield still a further embodiment. It is intended that the present invention include these and other modifications and variations.

"Attached" refers to the bonding, joining, adhering, connecting, attaching, or the like, of two elements. Two elements may be considered attached together when they are bonded directly to one another or indirectly to one another, such as when each is directly attached to an intermediate element.

"Elastomeric" refers to a material or composite which can be extended or elongated by at least 25% of its relaxed length and which will recover, upon release of the applied force, at least 10% of its elongation. It is generally preferred that the elastomeric material or composite be capable of being elongated by at least 100%, recover at least 50% of its elongation. An elastomeric material is thus stretchable and "stretchable", "elastomeric", and "extensible" may be used interchangeably.

"Elastic" or "Elasticized" means that property of a material or composite by virtue of which it tends to recover towards its original size and shape after removal of a force causing a deformation.

"Neck-bonded" laminate refers to a composite material having an elastic member that is bonded to a non-elastic member while the non-elastomeric member is extended in the machine direction creating a necked material that is elastic in the transverse or cross-direction. Examples of neck-bonded laminates are disclosed in U.S. Pat. Nos. 4,965,122; 4,981,747; 5,226,992; and 5,336,545, which are incorporated herein by reference in their entirety for all purposes.

"Stretch-bonded" laminate refers to a composite material having at least two layers in which one layer is a gatherable layer and the other layer is an elastic layer. The layers are joined together when the elastic layer is in an extended condition so that upon relaxing the layers, the gatherable layer is gathered. For example, one elastic member can be bonded to another member while the elastic member is extended at least about 25% of its relaxed length. Such a multiplayer composite elastic material may be stretched until the non-elastic layer is fully extended. Examples of stretch-bonded laminates are disclosed, for example, in U.S. Pat. Nos. 4,720,415, 4,789,699, 4781,966, 4,657,802, and 4,655,760, which are incorporated herein by reference in their entirety for all purposes.

As used herein, the term "nonwoven web" refers to a web that has a structure of individual fibers or filaments which are interlaid, but not in an identifiable repeating manner. Nonwoven webs have been, in the past, formed by a variety of processes known to those skilled in the art such as, for example, meltblowing and melt spinning processes, spunbonding processes and bonded carded web processes.

As used herein, the term "spunbonded web" refers to web of small diameter fibers and/or filaments which are formed by extruding a molten thermoplastic material as filaments from a plurality of fine, usually circular, capillaries in a spinnerette with the diameter of the extruded filaments then being rapidly reduced, for example, by non-eductive or eductive fluid-drawing or other well known spunbonding mechanisms. The production of spunbonded nonwoven webs is illustrated in patents such as Appel, et al., U.S. Pat. No. 4,340,563; Dorschner et al., U.S. Pat. No. 3,692,618; Kinney, U.S. Pat. Nos. 3,338,992 and 3,341,394; Levy, U.S. Pat. No. 3,276,944; Peterson, U.S. Pat. No. 3,502,538; Hartman, U.S. Pat. No. 3,502,763; Dobo et al., U.S. Pat. No. 3,542,615; and Harmon, Canadian Patent No. 803,714.

As used herein, the term "meltblown web" refers to a nonwoven web formed by extruding a molten thermoplastic material through an plurality of fine, usually circular, die capillaries as molten fibers into converging high velocity gas (e.g. air) streams that attenuate the fibers of molten thermoplastic material to reduce their diameter, which may be to microfiber diameter. Thereafter, the meltblown fibers are carried by the high velocity gas stream and are deposited on a collecting surface to form a web of randomly disbursed meltblown fibers. Such a process is disclosed, for example in U.S. Pat. No. 3,849,241 to Butin, et al., which is incorporated herein in its entirety by reference thereto for all purposes. Generally speaking, meltblown fibers may be microfibers that may be continuous or discontinuous, are generally smaller than 10 microns in diameter, and are generally tacky when deposited onto a collecting surface.

As used herein, the term "disposable" is not limited to single use or limited use articles but also refers to articles that are so inexpensive to the consumer that they can be discarded if they become soiled or otherwise unusable after only one or a few uses.

As used herein, the term "garment" refers to protective garments and/or shields including for example, but not limited to, surgical gowns, patient drapes, work suits, aprons and the like.

As used herein, the term "liquid resistant" or "liquid repellant" refers to material having a hydrostatic head of at least about 25 centimeters as determined in accordance with the standard hydrostatic pressure test AATCCTM No. 127-1977 with the following exceptions: (1) The samples are larger than usual and are mounted in a stretching frame that clamps onto the cross-machine direction ends of the sample, such that the samples may be tested under a variety of stretch conditions (e.g., 10%, 20%, 30%, 40% stretch); and (2) The samples are supported underneath by a wire mesh to prevent the sample from sagging under the weight of the column of water.

As used herein, the term "breathable" means pervious to water vapor and gases. For instance, "breathable barriers" and "breathable films" allow water vapor to pass therethrough, but are liquid resistant. The "breathability" of a material is measured in terms of water vapor transmission rate (WVTR), with higher values representing a more breathable material and lower values representing a less breathable material. Breathable materials generally have a WVTR of greater than about 250 grams per square meter per 24 hours ($g/m^2/24$ hours). In some embodiments, the WVTR may be greater than about 3000 $g/m^2/24$ hours. In some embodiments, the WVTR may be greater than about 5000 $g/m^2/24$ hours.

As used herein, the term "reversibly-necked material" refers to a necked material that has been treated while necked to impart memory to the material so that when force is applied to extend the material to its pre-necked dimensions, the necked and treated portions will generally recover to their necked dimensions upon termination of the force. A reversibly-necked material may include more than one layer. For example, multiple layers of spunbonded web, multiple layers of meltblown web, multiple layers of bonded carded web or any other suitable combination of mixtures thereof. The production of reversibly-necked materials is illustrated in patents such as, for example, Mormon, U.S. Pat. Nos. 4,965,122 and 4,981,747.

The present invention relates to a unique configuration for a protective garment. The garment is illustrated and described herein as a surgical gown for illustrative purposes. It should be appreciated though that a garment in accordance with the invention is not limited to a gown, and may include, for example, a patient gown or drape, work coverall, robe, etc. A conventional gown 100 is conceptually illustrated in FIG. 1. The gown includes a gown body 12 having a front portion 14 and a back portion 16. The gown body may be formed from a single piece of material, or may be defined by separate panels of material joined at seams. Sleeves 22 are generally attached to the gown body at sleeve openings defined in the body 12. The sleeves 22 may be of the same or a different material as the body 12. Various configurations of gowns 100 are well known to those skilled in the art and all such configurations are within the scope and spirit of the invention.

The gown material is generally a breathable yet liquid resistant barrier material. The breathability of the material increases the comfort of someone wearing such a garment, especially if the garment is worn under high heat index conditions, vigorous physical activity, or long periods of time. Various suitable woven and non-woven barrier materials are known and used in the art for garments such as surgical gowns, and all such materials are within the scope of the present invention. A suitable gown material is, for example, a Spunbond-Meltblown-Spunbond Laminate as described in U.S. Pat. No. 5,464,688 incorporated herein by reference for all purposes, with appropriate chemical treatments to enhance repellency and static decay.

Still referring to FIG. 1, it has been determined that the areas of greatest restrictive force generated when the gown 100 is donned and the wearer's arms are extended outwardly are the back shoulder areas adjacent to the sleeves. The restrictive forces felt by the wearer are generated by tensile stretching forces exerted on the material. The restrictive force areas are designated generally by the dashed-line areas 32 in FIG. 1. The present applicants have found that the restrictive forces can be greatly alleviated by first identifying the precise areas wherein the tensile stretching force is generated, and then replacing the non-lastomeric gown material in these areas with isolated zones or patches of elastomeric material. By precisely mapping the stressed areas, the amount of elastomeric material used in the gown is minimized and a more comfortable gown can be made with little additional cost. Embodiments of garments, e.g., gowns, according to the invention are described in greater detail below with reference to FIGS. 3–4.

Figure 2A:
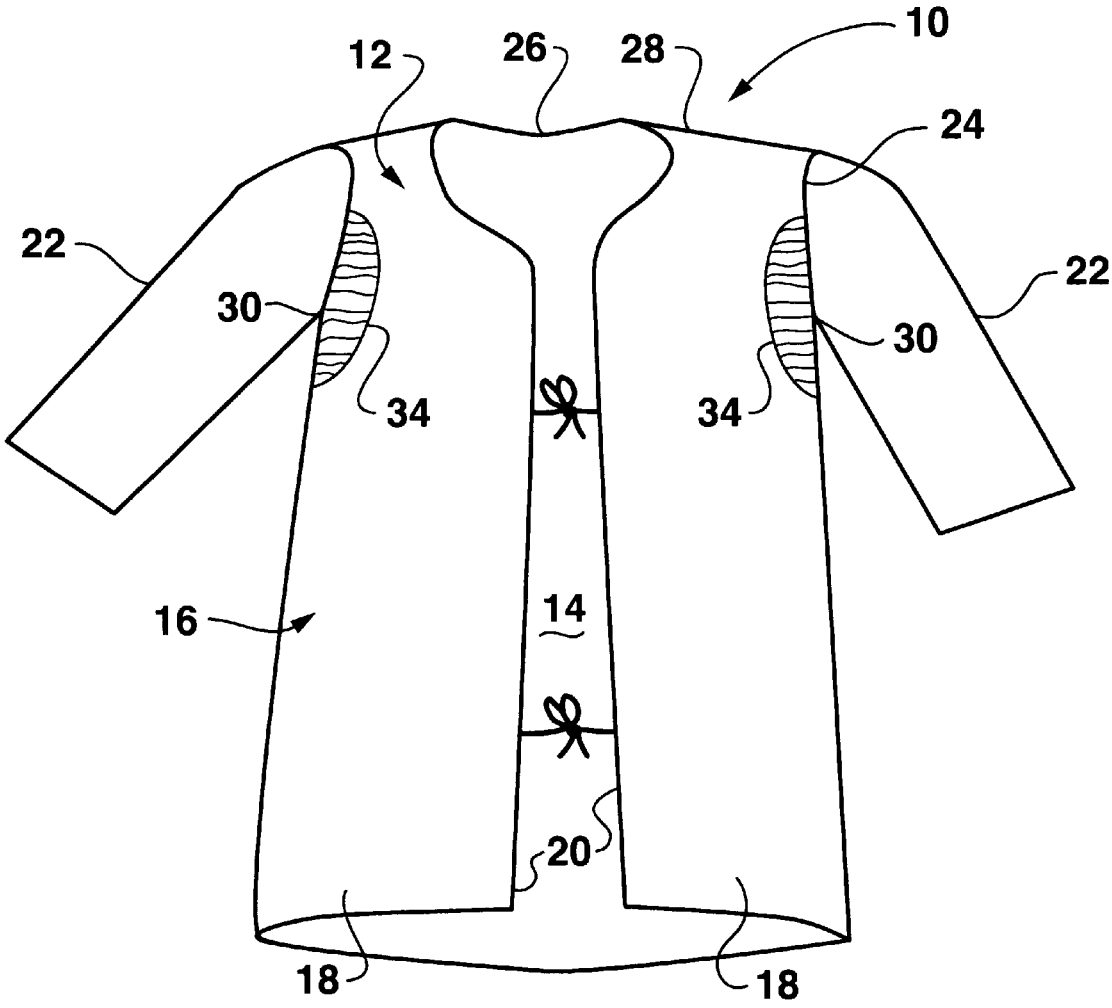
FIG. 2A is a perspective view of a garment in accordance with the present invention.
Figure 3A:
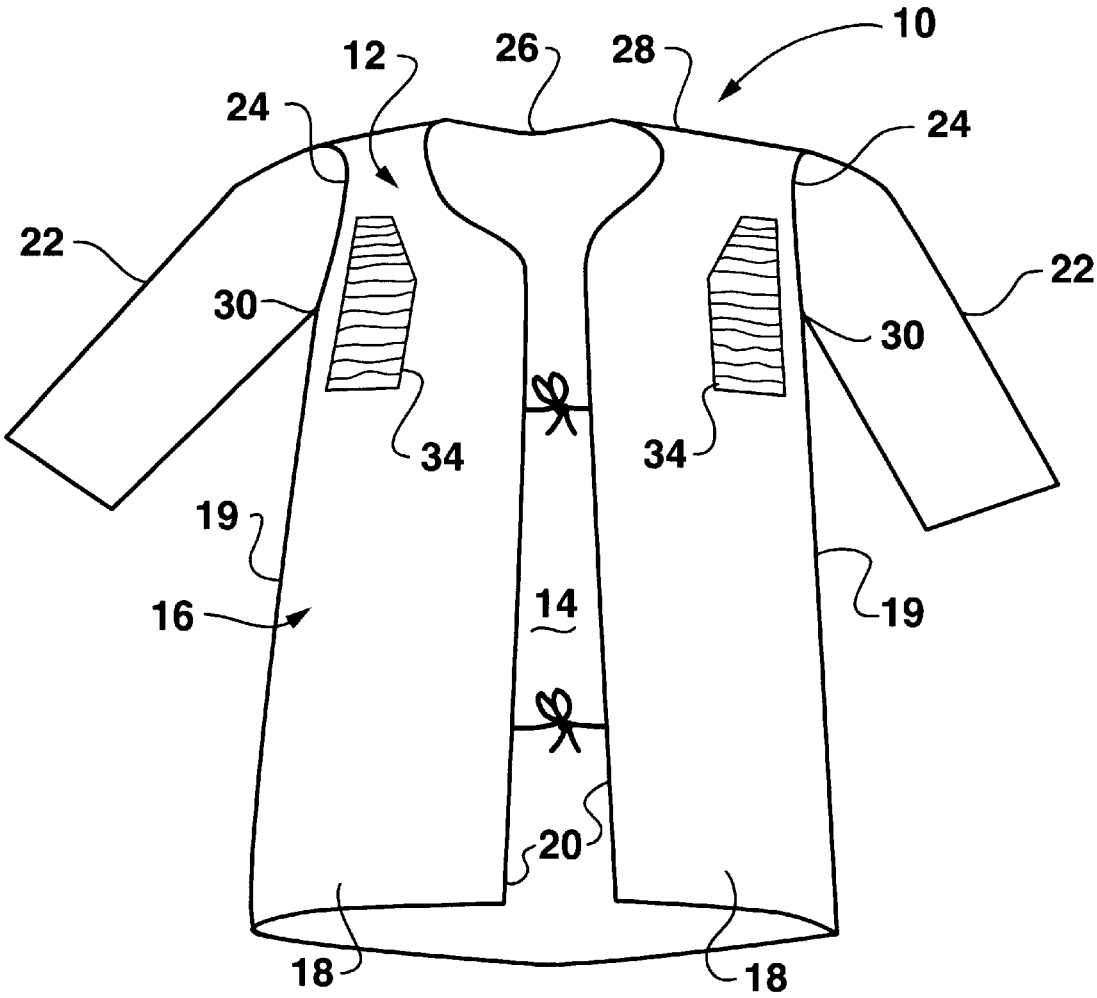
FIG. 3A is a perspective view of a garment in accordance with the present invention.

FIG. 2A illustrates a gown 10 in accordance with the invention. The gown 10 is similar in many aspects to the conventional gown illustrated in FIG. 1. The gown 10 includes a gown body 12 having a front 14 and a back 16. The back 16 may be an open back defined by adjacent back portions 18 having opposite longitudinal edges 20. The back portions 18 include back shoulder regions, back waist regions, lower regions, etc. Any type of known fastening means, such as convention ties, may be used for securing the gown 10 on a wearer. The gown body 12 may be formed from a single piece of material, such as a breathable yet liquid impervious barrier material, defining a neck opening 26 and sleeve openings 24. Sleeves 22 are attached to the gown body 12 at the sleeve openings 24 by any conventional attaching means. In an alternate embodiment, the gown body 12 may be formed from separate panels of the same or different materials that are attached or adhered along seams. For example, the back panels 18 may be panels of material adhered to a front panel of material defining the front portion 14 along sides seams 19 (FIG. 3A).

Figure 2B:
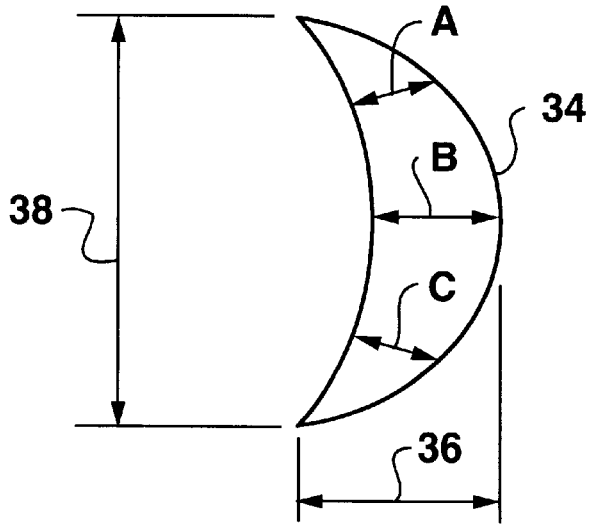
FIG. 2B is an enlarged planar view of the elastomeric panel used in the garment of FIG. 2A.

Patches of elastomeric material 34 are formed into areas 32 of the gown body 12 generating the greatest restrictive forces. The location of such areas is not limiting and may vary depending on the overall style, configuration, and size of the gown 10. A method for precisely defining such areas 32 is described in greater detail below. In the illustrated embodiment, the areas 32 are located in the back shoulder portions of the gown body 12. The geometric shape of the elastomeric patches 34 may vary depending on the size and shape of the areas 32 of the gown body 12 generating the restrictive forces. By precisely mapping the restrictive force areas 32, a more precise shape of the patches 34 is possible. In FIGS. 2A and 2B, the patches 34 are generally crescent shaped and follow the contour of the sleeve openings 24. The crescent shapes extend laterally between the sleeve openings 24 and longitudinal edges 20 of the back panels 18. As can be seen in the figures, the patches 34 are generally completely surrounded by the gown body material, which may be non-elastomeric or less elastomeric then the patches 34. In this regard, the patches may be thought of as "islands" of elastomeric material corresponding to the location of the restrictive force areas 32.

Figure 3B:
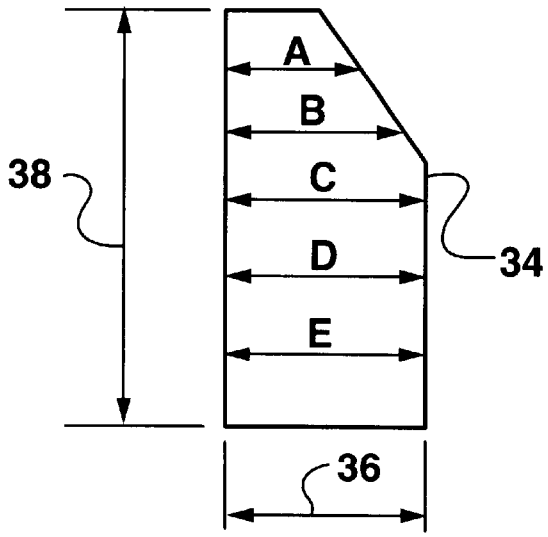
FIG. 3B is an enlarged planar view of the elastomeric panel used in the garment of FIG. 3A.

For the back shoulder regions of a gown 10, it has been found that the patches 34 may have various shapes and extend laterally along the back portions between sleeve openings or seams 24 and the longitudinal edges 20 of the back portions 18, and extend longitudinally from a point below an underside 30 of the sleeves 22 to point between the underside 30 and a top edge 28 of the gown body 12. Referring to FIGS. 2B, 3B, and 4B, the longitudinal dimension 38 of the patches 34 may be greater than the lateral dimension 36. In one embodiment, the patches 34 may extend at least about one-third of the length between the underside 30 of the sleeves 22 and the top edge 28 of the gown body 12. For example, the patches 34 may extend about one-half of the length between the underside 30 of the sleeves and top edge 28 of the gown body.

The elastomeric patches 34 are stretchable in the general directions of the tensile forces exerted on the areas 32. For example, if the patches 34 are located in the back shoulder regions as illustrated in the figures, the patches 34 are stretchable at least in the lateral direction across the back of a wearer. The arrow lines in FIGS. 2B, 3B, and 4B conceptually illustrate the general stretch directions of the patches 34 located in the back shoulder regions of the respective gowns in FIGS. 2A, 3A, and 4A. In an embodiment wherein the areas 32 are subjected to longitudinal stretching forces (for example, at the back waist region when the wearer bends over), the patches 34 may be stretchable at least in the longitudinal direction. It may be desired that the patches 34 be elastomeric in generally all directions to maximize benefit of the patches.

The patches 34 are formed into the gown material by any suitable method. For example, the patches may be sonically or ultrasonically welded to the gown material. The patches 34 may be stitched, taped, or adhered to the gown material. The patches 34 may be thermally bonded to the gown material. Any one of a number of known conventional attaching methods may be used for this purpose.

Various elastomeric materials are known in the art that may be used for the patches 34. The patches 34 may, for example, be composed of a single layer, multiple layers, laminates, spunbond fabrics, films, meltblown fabrics, elastic netting, microporous web, bonded carded webs or foams comprised of elastomeric or polymeric materials. Elastomeric nonwoven laminate webs may include a nonwoven material joined to one or more gatherable nonwoven webs, films, or foams. Stretch-bonded-laminates (SBL) and Neck-bonded-laminates (NBL) are examples of elastomeric nonwoven laminate webs. Nonwoven fabrics are any web of material which has been formed without the use of textile weaving processes which produce a structure of individual fibers which are interwoven in an identifiable repeating manner. Examples of suitable materials are Spunbond-Meltblown fabrics, Spunbond-Meltblown-Spunbond fabrics, Spunbond fabrics, or laminates of such fabrics with films, foams, or other nonwoven webs. Elastomeric materials may include cast or blown films, foams, or meltblown fabrics composed of polyethylene, polypropylene, or polyolefin copolymers, as well as combinations thereof. The elastomeric materials may include polyether block amides such as PEBAX® elastomer (available from AtoChem located in Philadelphia, Pa.), thermoplastic polyurethanes (e.g., both aliphatic-polyether and aliphatic-polyester types), HYTREL® elastomeric copolyester (available from E. I. DuPont de Nemours located in Wilmington, Del.), KRATON® elastomer (available from Shell Chemical Company located in Houston, Tex.), or strands of LYCRA® elastomer (available from E. I. DuPont de Nemous located in Wilmington, Del.), or the like, as well as combinations thereof. The patches 34 may include materials that have elastomeric properties through a mechanical process, printing process, heating process, or chemical treatment. For examples such materials may be apertured, creped, neck-stretched, heat activated, embossed, and micro-strained; and may be in the form of films, webs, and laminates.

In one particular embodiment, the elastomeric patches 34 are a neck-bonded laminate of a necked non-woven web of spunbond polypropylene laminated to an elastic film, for example a 6.8 gsm PEBAX film with 16% (by weight) of pigment grade titanium dioxide particles.

FIG. 3A is a perspective view of an alternate embodiment of a gown 10 according to the invention. The gown 10 is similar to the gown described above with respect to FIG. 2A with the exception of the elastomeric patches 34. In this embodiment, the patches 34 have an overall elongated trapezoidal profile with a straight edge that wherein is generally parallel to the sleeve seam 24. This edge extends slightly below the underside 30 of the sleeve 22 and extends in the opposite direction generally to adjacent the top edge 28 of the gown. However, as described in greater below, the upper portion of the patches 34 may extend beyond areas of the gown body subjected to tensile stressing forces and, thus, may not be necessary.

It may be found that the elastomeric patches 34 do not need to extend generally beyond one-half of the distance or length between the underside 30 of the sleeve 22 and the top edge 28 of the gown body. The elastomeric panel 34 is shown in an enlarged view in FIG. 3B. As can be seen from this figure, the panel 34 has a longitudinal dimension 38 that is significantly greater than the lateral dimension 36.

A method according to the invention may be used to fairly precisely define or map out the areas in a protective garment, such as but not limited to a surgical gown, subjected to tensile stressing forces. Once defined, these areas may be substituted with elastomeric patches as described above. The applicants have found that an accurate method for mapping these areas is to place oversized elastomeric patches in the regions of the garment generally noted by individuals as applying restrictive forces in normal use of the garment. For example, users typically note that a noticeable restrictive force is placed across the back upper shoulder regions of surgical gowns, particularly when the users extend their arms forward. Other restrictive forces may be felt, for example, in the waist regions when the user bends forward or leans sideways, etc.

Once suspected or generalized areas have been identified, an oversized area of the gown corresponding to such locations may be removed from a prototype or "working" model of the gown (i.e. cut out of the gown). Pieces of elastomeric material may then be attached to the gown superimposed over the cut out areas. In an alternate embodiment, the working model may be formed essentially entirely of an elastomeric material. A grid is then defined on the elastomeric material. The grid may be, for example, a block pattern, line pattern, etc. The grid essentially provides an array of distinct marks or lines that will change relative position upon the elastomeric material being stretched. The change in relative position is measured and the areas of maximum relative change between the marks correspond to the areas of greatest tensile stress and thus the areas of greatest restrictive force felt by the wearer. The areas of least relative change between the marks corresponds to the areas of least tensile stress. Areas wherein the marks essentially do not change correspond to areas of the gown that are not generally susceptible to tensile stress, and thus to areas that will not benefit by substitution of elastomeric material.

For example, referring to FIGS. 2A and 2B, the crescent shape patches 34 were first attached to the gown in the position shown in FIG. 2A, and then the gown material occluded by the patches 34 was removed. A grid of three arrays of spaced apart lines was marked onto the patches 34 in the locations indicated by the arrows A, B, and C in FIG. 2B. The lines were relatively small vertical lines spaced about one centimeter apart. The arrays of lines thus resembled the markings on a conventional measuring tape. The first array A was defined approximately 20 centimeters from the top edge 28 of the gown body 12. The second array B was defined approximately 25 centimeters from the top edge 28, and the third array C was defined approximately 34 centimeters from the top edge 28 and slightly angled with respect to the other arrays, as illustrated generally in FIG. 2B. The gown 10 was donned and the wearer instructed to move about so as to generate the tensile stretching forces in the back shoulder regions, for example by extending the arms outward in front of their torso and crossing the arms. Under this condition, the change in the spacing between the lines was measured. The material along the first array B extended or stretched 40 percent (the material had a stretched length of 140 percent of its relaxed length), the elastomeric material along the second array B extended 50 percent, and the elastomeric material along the third array C extended 25 percent. Upon the wearer relaxing the arms, the grid lines along the arrays returned to their initial spacing indicating that the restrictive forces were stopped.

It should be appreciated that this grid mapping technique may be utilized to accurately determine the locations of tensile forces generated anywhere on a garment body resulting in restrictive forces against the wearer. The method is empirical by nature and there will obviously be some degree of trial and error. However, by widening the grid areas and measuring different patterns resulting from various movements of a wearer, areas 32 that are subjected to tensile forces may be accurately determined and, if desired, substituted with elastomeric patches 34, as described above.

With respect to the embodiments of FIGS. 3A and 3B, the length of the elastomeric patches 34 was longitudinally extended towards the top edge 28 of the gown body 12 to determine to what extent tensile forces are generated closer to the top edge 28. Five arrays of grid lines A through E were defined on the elastomeric patches 34 at the positions and direction indicated in FIG. 3B. The elastomeric panel was positioned in the gown body 12 to include the area in the upper back panel adjacent to the sleeve, as well as the area adjacent to the underarm of the sleeve. A border of the original non-elastomeric gown material was retained around the neck and sleeve edges to facilitate positioning and retaining of the elastomeric material. The first array of lines A were defined 16 centimeters from the top edge 28. The second array defined at 22 centimeters from the top edge, the third array C at about 29 centimeters from the top edge, the fourth array D at about 39 centimeters from the top edge, and the fifth array E at about 46 centimeters from the top edge of the gown. The gown was then donned and subjected to the same conditions as described above with respect to the gown of FIG. 2A. Extension in the elastomeric patches 34 was observed via changes in the spacing between the grid lines in the arrays. It was noted that no extension was observed along the grid lines corresponding to grids A and B. The material extended about 25 percent along grid pattern C, and about 50 percent along grid patterns D and E. Thus, it was determined that elastomeric material extending above grid pattern B does not add any significant benefit. It was also noted that the bottom edge of the elastomeric patches in FIGS. 2A and 3A was located the same distance from the top edge 28 of the gown body. However, with the shape and configuration of the elastomeric patches 34 in FIGS. 3A and 3B, the elastomeric material extended or stretched 50 percent along the bottom array E as compared to 25 percent along the bottom array C in the crescent shaped panel 34 used in FIGS. 2A and 2B. It may be that the crescent shape of the panel 34 did not adequately extend into areas subjected to tensile stressing forces. It should thus be apparent that the shape of the elastomeric patches 34 may also play a role in the degree or magnitude of relief provided by the patches.

Figure 4A:
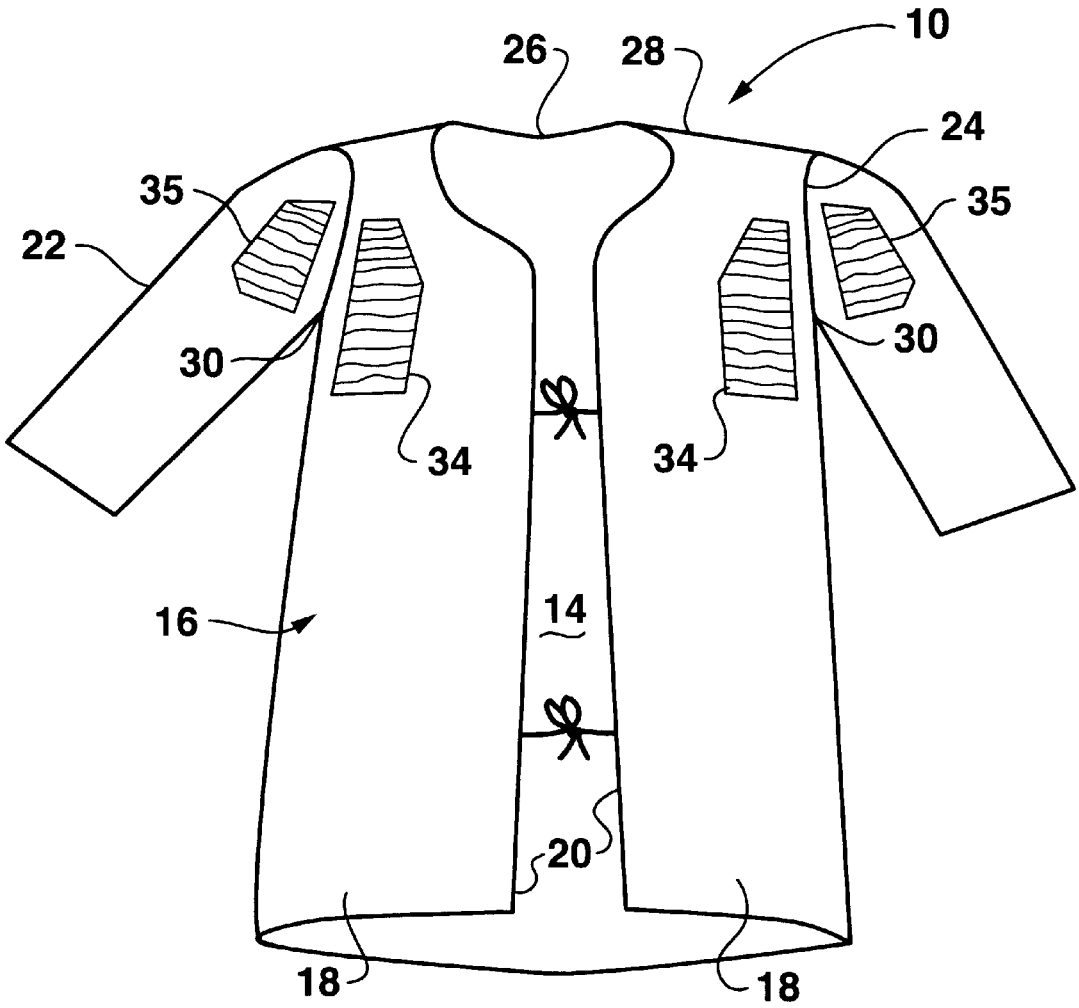
FIG. 4A is a perspective view of a garment in accordance with the present invention.
Figure 4B:
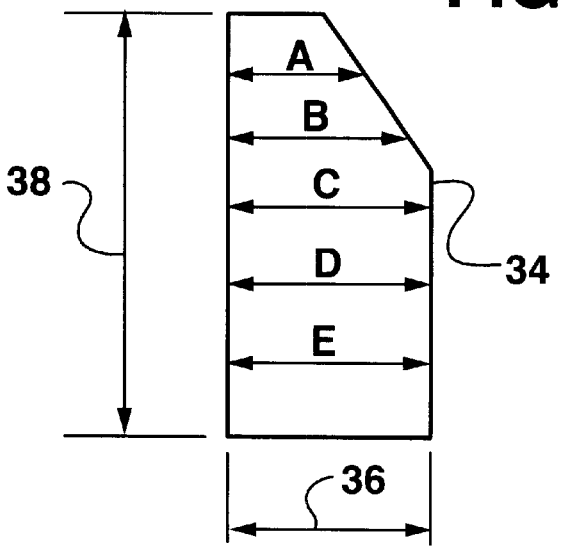
FIGS. 4B and 4C are an enlarged planar view of the elastomeric patches used in the garment of FIG. 4A.
Figure 4C:
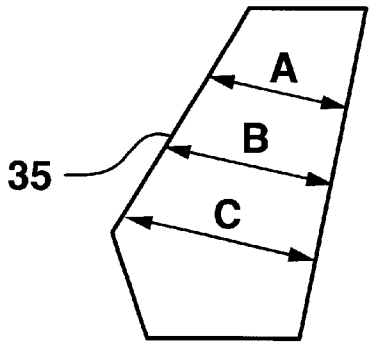

The gown of FIGS. 4A and 4B is essentially identical to that of FIGS. 3A and 3B with the exception that an additional elastomeric panel 35 was attached to the upper portion of each sleeve to determine if this area of the gown also contributed to the restrictive forces felt by the wearer. Grid patterns A, B, and C were defined on the panel 35 as indicated in FIG. 4C. The gown was then donned and subjected to the same conditions as described above with respect to the other gowns. It was noted that the grid patterns A, B, and C for the patches 35 indicated no extension or stretch of the materials. Thus, it was accurately determined that this portion of the gown body was not subjected to tensile stretching forces and did not contribute to restrictive forces felt by the wearer.

Figure 5:
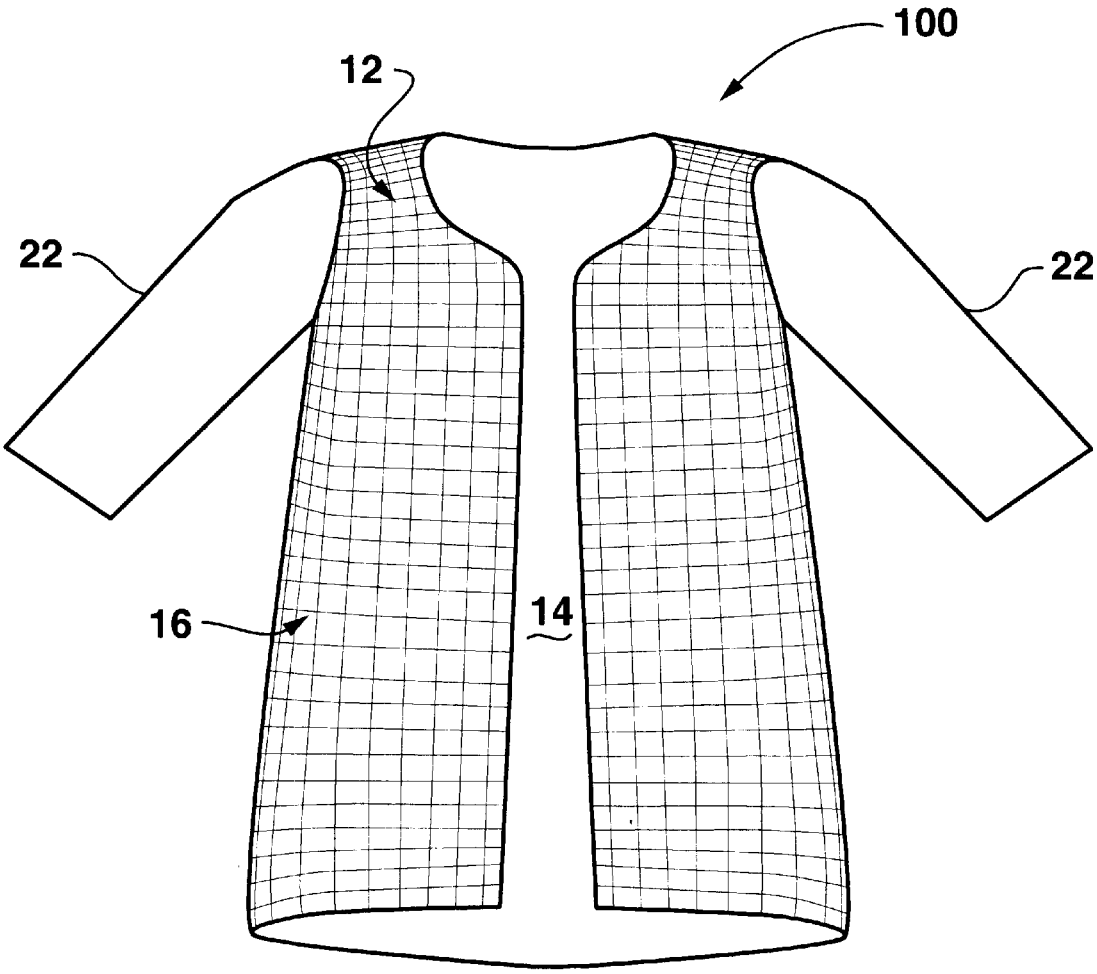
FIG. 5 is perspective view of a prototype working gown used in the method of the invention, the gown having a grid pattern defined on the body thereof.
Figure 6A:
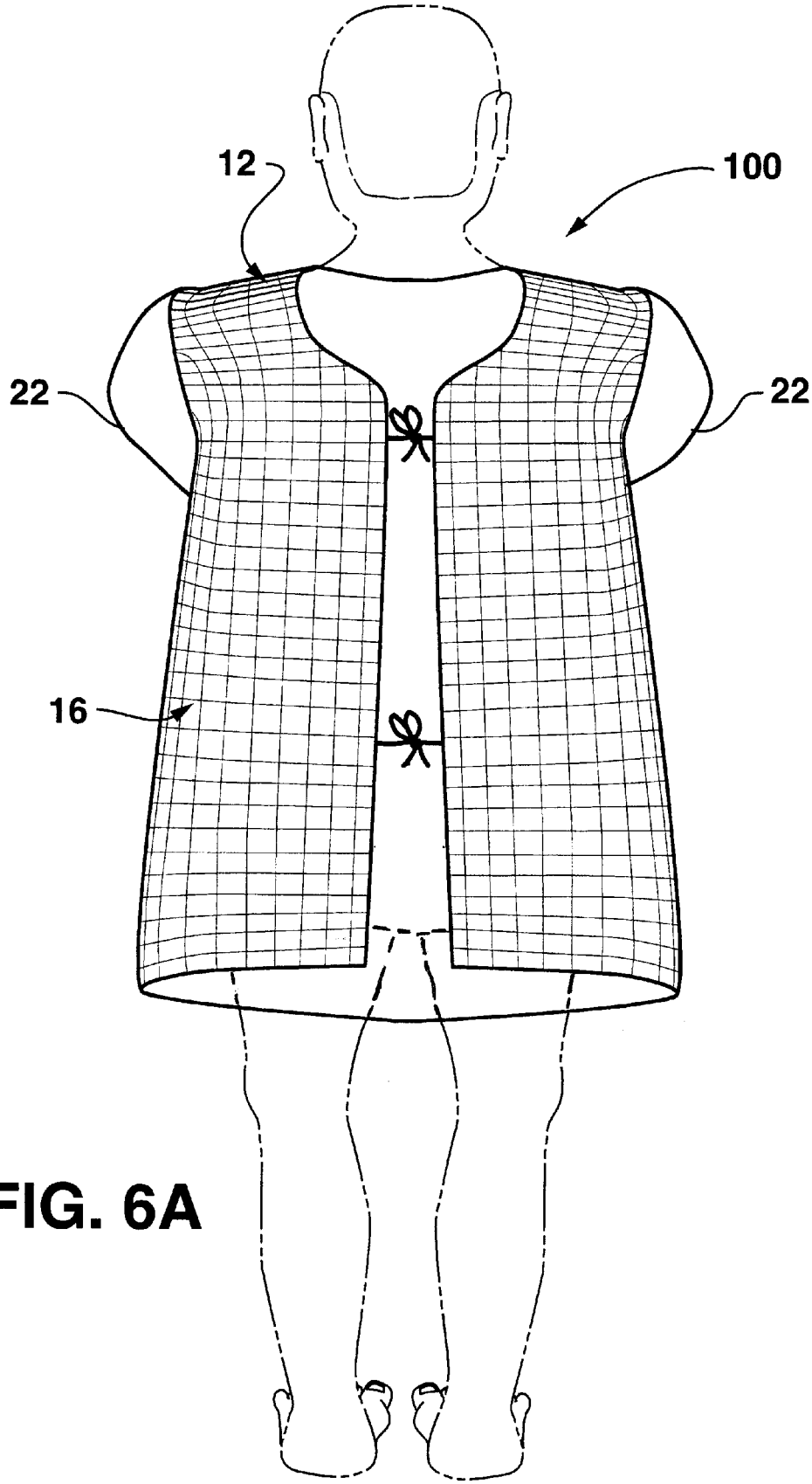
FIG. 6A is a perspective view of the prototype gown being worn by an individual and subjected to a range of motion so that the areas subjected to tensile stretching forces may be identified.
Figure 6B:
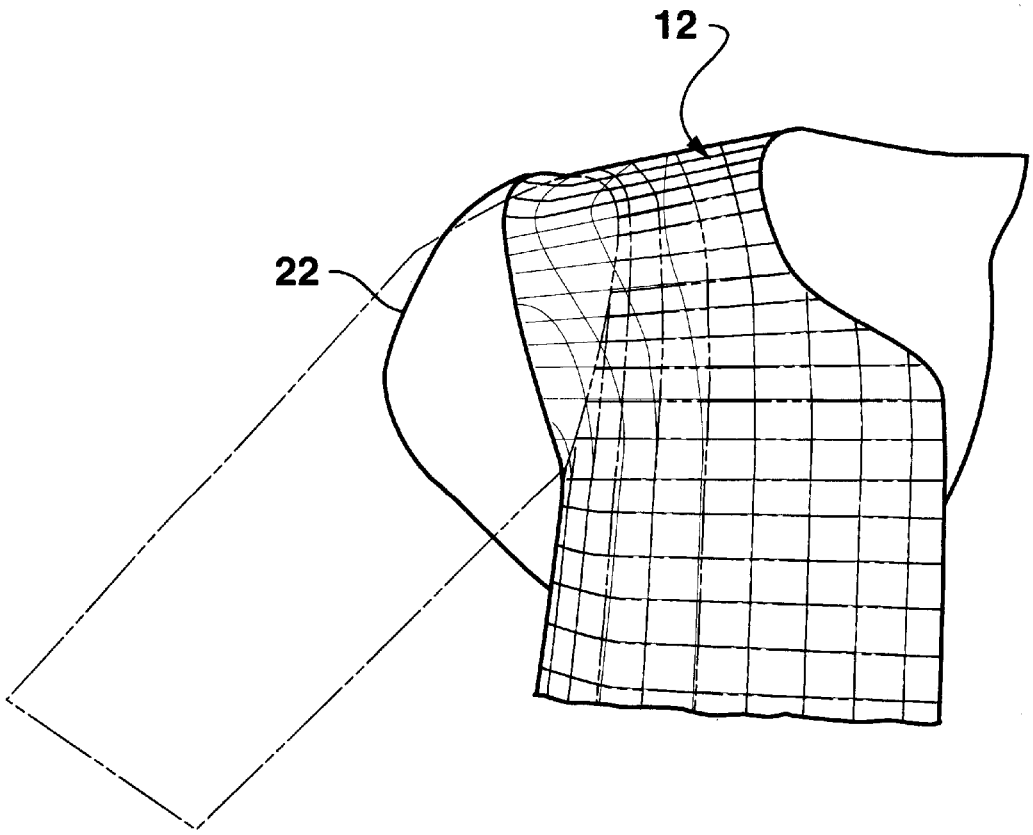
FIG. 6B is an enlarged view of the back shoulder area of the gown indicated in FIG. 6A.

Aspects of the method according to the invention are illustrated generally in FIGS. 5, 6A, and 6B. A method in accordance with the invention for making a protective garment having at least one patch of elastomeric material formed therein may include providing a working model or prototype of the garment, and providing elastomeric material in areas of the garment believed to be subjected to tensile stretching forces when the garment is worn by a wearer. Referring to FIG. 5, a working model or prototype garment 100 is illustrated. In this embodiment, at least the back 16 of the gown is formed by panels of elastomeric material. It may be desired that the entire gown body 12 be formed of elastomeric material. A pattern of marks are defined on the elastomeric material. The marks may take on any defined pattern. For example, the marks may be defined as spaced apart longitudinally oriented lines, spaced apart transversely oriented lines, or a combination of transverse and longitudinal lines. For example, in the illustrated embodiment, the marks are defined essentially by a parallelogram pattern, for example a pattern of squares or rectangles. Any suitable pattern of marks may be used in accordance with the invention.

Referring to FIG. 6A, the working garment 100 is donned by a wearer and the garment is subjected to conditions to induce the tensile stretching forces. For example, the wearer may conduct various movements or ranges of movements to induce the tensile stretching forces. In the illustrated embodiment, the wearer has raised and extended his arms forward, and may cross the arms to induce maximum tensile stretching forces. As is graphically illustrated in FIG. 6A, as the elastomeric material in the areas of the gown subjected to tensile stretching forces elongates, the grid pattern markedly changes. This can be particularly seen in the back shoulder areas of the gown illustrated in FIG. 6A. FIG. 6B is an enlarged view of the back shoulder area and particularly illustrates the change in the shape and orientation of the marks.

By detecting and measuring the change and relative positions of the marks resulting from stretching of the elastomeric material, one is able to map the areas of the garment subjected to tensile stretching forces and to determine the relative amount of stress or stretching forces by the magnitude of the change in spacing or orientation of the marks. Once the areas have been mapped, it is then possible to produce production gowns wherein patches of elastomeric material are substituted for the generally non-elastomeric gown material in the mapped areas that are subjected to the tensile stretching forces.

It should be appreciated that the method is not limited to any particular grid pattern or measurement technique. The grid pattern may be disposed to detect generally only stretching of the elastomeric material in a generally transverse direction. Likewise, the pattern may be defined so as to determine the degree of stretching of the elastomeric material in a generally longitudinal direction. Desirably, the grid pattern may be defined so as to determine the degree of stretching of the elastomeric material in both a generally transverse and generally longitudinal direction. All such variations are in accordance with the scope and spirit of the invention.

It should be appreciated by those skilled in the art that the system and method according to the invention have wide applications, and that the example and embodiments set forth herein are merely exemplary. It is intended that the present invention include such uses and embodiments as come within the scope and spirit of the appended claims.

What is claimed is:

1. A method for making a protective production garment having at least one patch of elastomeric material formed therein, said method comprising:

with a working model of the garment, providing an elastomeric material in areas believed to be subjected to tensile stretching forces when worn by a wearer;

defining a pattern of marks on the elastomeric material;

subjecting the garment to conditions to induce the tensile stretching forces;

detecting and measuring the change in relative positions of the marks resulting from stretching of the elastomeric material;

mapping the areas of the garment subjected to tensile stretching forces based on the degree of stretching indicated by the marks; and providing patches of elastomeric material in production garments in at least one of the mapped areas subjected to tensile stretching forces.

2. The method as in claim 1, wherein the modeling garment has a body formed generally entirely of the elastomeric material.

3. The method as in claim 1, wherein the production gowns are formed of a generally non-elastomeric material, the patches of elastomeric material surrounded by the non-elastomeric material.

4. The method as in claim 2, wherein the patches of elastomeric material are attached to the non-elastomeric material by one of a thermal bonding, ultrasonic bonding, and adhesive process.

5. The method as in claim 1, wherein the pattern of marks are defined as arrays of spaced apart lines, the degree of stretching of the elastomeric material in one direction determined by the change in spacing between the lines.

6. The method as in claim 5, wherein the degree of stretching of the elastomeric material in a generally opposite direction is determined by elongation of the lines.

7. The method as in claim 1, wherein the pattern of marks is defined so as to determine the degree of stretching of the elastomeric material in a generally transverse direction.

8. The method as in claim 1, wherein the pattern of marks is defined so as to determine the degree of stretching of the elastomeric material in a generally longitudinal direction.

9. The method as in claim 1, wherein the pattern of marks is defined so as to determine the degree of stretching of the elastomeric material in a generally transverse and generally longitudinal direction.

10. The method as in claim 9, wherein the pattern of marks is defined as a pattern of generally transverse lines and longitudinal lines.

11. The method as in claim 10, wherein the pattern of marks is defined as parallelograms.

12. A method for defining areas of a garment that are subjected to tensile stretching forces when worn by a wearer, said method comprising:

providing a working model of the garment having an elastomeric material in areas believed to be subjected to tensile stretching forces when worn by a wearer;

defining a pattern of marks on the elastomeric material;

subjecting the garment to conditions to induce the tensile stretching forces;

detecting and measuring the change in relative positions of the marks resulting from stretching of the elastomeric material; and mapping the areas of the garment subjected to tensile stretching forces based on the degree of stretching indicated by the marks.

13. The method as in claim 12, wherein the elastomeric material and marks are provided in the working model in localized areas encompassing areas believed to be subjected to tensile stretching forces.

14. The method as in claim 12, wherein the body of the working model of the garment is formed of the elastomeric material with the marks defined thereon.

* * * * *